United States Patent [19]

Lu et al.

[11] 3,954,640

[45] May 4, 1976

[54] ELECTROSTATIC PRINTING INKS

[75] Inventors: Chin H. Lu, Webster; David A. Allen, Sodus, both of N.Y.

[73] Assignee: Xerox Corporation, Stamford, Conn.

[22] Filed: June 27, 1973

[21] Appl. No.: 374,159

[52] U.S. Cl. ..... 252/62.1 L
[51] Int. Cl.[2] ..... C03G 9/00
[58] Field of Search ..... 252/62.1 L

[56] References Cited

UNITED STATES PATENTS

| | | | |
|---|---|---|---|
| 3,625,897 | 12/1971 | Machida | 252/62.1 L |
| 3,689,260 | 9/1972 | Honjo et al. | 252/62.1 L X |
| 3,717,461 | 2/1973 | Honjo | 252/62.1 L X |
| 3,729,418 | 4/1973 | Machida et al. | 252/62.1 L |
| 3,753,760 | 8/1973 | Kosel | 252/62.1 L |
| 3,779,924 | 12/1973 | Chechak | 252/62.1 L |
| 3,853,554 | 12/1974 | Maki et al. | 252/62.1 L |

*Primary Examiner*—Samuel Feinberg
*Assistant Examiner*—Peter A. Nelson
*Attorney, Agent, or Firm*—James J. Ralabate; Donald C. Kolasch; Ernest F. Chapman

[57] ABSTRACT

Liquid developer compositions for development of latent electrostatic images are disclosed. The electrostatic printing inks dry at ambient temperatures by penetration into paper leaving a continuous film having excellent rub resistance on the surface. The non-volatile, low viscosity inks comprise about 3–20% pigment and/or dye, about 5–35% of resinous particles having a size of 5 microns or less and having glass transition temperatures close to or below ambient temperature, said resinous particles being dispersed in the liquid carrier, 0–25% dispersing agent and about 25–90% non-volatile, high boiling organic liquid carrier and/or solvent.

16 Claims, No Drawings

ELECTROSTATIC PRINTING INKS

BACKGROUND OF THE DISCLOSURE

This invention relates to electrostatic printing methods and compositions and more particularly to an improved ink and liquid developer composition for converting a latent electrostatic image to a visible image, the fixed image having improved rub resistance.

Processes for forming latent electrostatic images, existing as electrostatic charge patterns upon a substrate, and for subsequently converting the latent electrostatic image into a visual pattern, are well known. Generally, such electrostatic techniques have been carried out by using toners which are dry powders. However, many techniques have been developed in which the toner particles are suspended in a liquid carrier, and in electrostatic printing wherein latent electrostatic images are formed on a photoconductive surface of a recording element by uniformly charging the surface thereof, as by a corona discharge device, followed by exposure to light in the desired image pattern, such images may also be developed by liquid developers.

Liquid developer compositions for developing electrostatic images generally comprise a dispersion of pigment or toner particles in a volatile, insulating liquid of high dielectric strength and high volume resistivity, generally in excess of $10^9$ ohm-cm. The dispersed particles may carry either a positive charge or a negative electrical charge, depending upon their chemical composition, the non-conductivity and the high dielectric strength of the volatile liquid in the liquid developing composition preserves the electrostatic image permitting the deposition of the dispersed toner particles to form a visible image. Generally these liquid developer compositions have been commercially available inks comprising water or oil bases. Other suitable insulating liquids have included aromatic hydrocarbons, such as, benzene, toluene, and xylene; aliphatic hydrocarbons, such as, hexane, cyclohexane, and heptane; freons and halogenated hydrocarbons; and silicone oils.

Liquid toners or developers are described in U.S. Pat. No. 2,907,674, U.S. Pat. No. 2,899,335, U.S. Pat. No. 2,890,911, U.S. Pat. No. 3,135,095, U.S. Pat. No. 3,155,546, and U.S. Pat. No. 3,535,244.

In one type of liquid development the suspended toner particles are electrostatically charged and develop the latent image by migration of the particles to the image surface under influence of the image charge. This is known as electrophoretic development and utilizes the developers having insulating liquids of relatively high volume resistivity.

In another type of electrostatic image development disclosed by Gundlach in U.S. Pat. No. 3,084,043 and U.S. Pat. No. 3,551,146, liquid developers having relatively low viscosity, low volatility, contrast in color in the usual case to the surface on which it will remain, and relatively high electrical conductivity (relatively low volume resistivity), are disclosed for converting the electrostatic latent image to a visible image. According to this method liquid developer from a reservoir is deposited on a gravure roller and fills the depression in the roller surface. Excess developer is removed from the lands between depressions, and as a receiving surface charged in image configuration passes against the gravure roller, the liquid developer is attracted from the depressions in image configuration by the charge.

This method of development is referred to as polar liquid development.

Although many inks and liquid developing compositions are known, none of the inks or liquid developers are entirely satisfactory from the standpoint of producing a permanent visible image which is free of smear or blurring especially when rubbed, that is, they do not have rub resistance. This results from the inability of the toner particles to become permanently fixed on the surface of the substrate to which the liquid developer or ink is transferred in image configuration. Attempts have been made to overcome this problem by fixing the image by subsequent processing, for example, by heating to fuse the toner particles, but such additional processing steps are generally undesirable.

Further attempts have been made to formulate the liquid developing composition by using a major portion of a low boiling liquid which is a nonsolvent for the organic binder, and a minor portion of a higher boiling liquid in which the organic binder is soluble, whereby the lower boiling liquid evaporates off more rapidly than the higher boiling liquid which thus increases in concentration towards the end of the drying cycle to the level whereby it becomes effective to reduce the organic binder to a state for fixing the colored particles. However, evaporation can be a problem with these volatile liquid developers which are organic in nature. The evaporation of the solvents results in pollution of the surrounding air, a very undesirable characteristic in view of present day efforts to reduce or eliminate contaminants in the air. Furthermore, such characteristics contribute to the inability to control the consistency of the ink because evaporation of the carrier upon standing will change the viscosity and other characterisitics of the liquid developer.

Still other attempts have been made to produce liquid developing compositions with a resinous or polymeric component dissolved therein as a binder, or with a liquid system containing a solvent which partially dissolves or softens a resinous component contained in the suspension or which forms a part of the pigment particles for the purpose of bonding the particles onto the copy sheet. However, when such organic binder components are dissolved or partially dissolved in the carrier there is an agglomeration of the toner particles with resulting separation in the developing composition and non-uniformity in the deposition of the toner or coloring agent particles for development of the visible image. Furthermore, this type of liquid developer dries on applicator rolls if a volatile solvent is used, and thereby causes staining of the original copies, sticking of the rollers, and cobwebbing in operation of applicator rolls, and if non-volatile solvent is used, the image obtained invariably has poor rub resistance.

OBJECTS OF THE INVENTION

Accordingly, it is an object of the present invention to produce an ink or liquid developer composition having a relatively high electrical resistivity for development of latent electrostatic images wherein the deposited coloring agent therein becomes permanently fixed to the copy substrate to produce copies which have excellent contrast and which have excellent rub resistance.

It is an object of the present invention to produce an ink or liquid developer composition which does not require additional processing steps, such as fusing, to fix the toner particles deposited during development of the image to the substrate upon which they are deposited.

It is still another object of the present invention to produce an ink or liquid developer composition wherein the toner particles and resinous and polymeric components are free from agglomeration or separation.

It is still another object of the present invention to provide a non-conductive ink or liquid developer composition which dries at ambient temperature by solvent penetration into the substrate upon which the resin particles are deposited leaving a continuous film having excellent rub resistance on the surface.

Another object of the present invention is to provide a process wherein improved non-conductive ink or liquid developer compositions are applied in image configuration to a surface having a latent electrostatic image thereon.

Still further objects and advantages of the novel ink or liquid developer composition and method of the present invention will become apparent from the following more detailed description thereof.

SUMMARY OF THE INVENTION

We have discovered that the above objects may be carried out by providing an ink comprising about 3–20% coloring agent, about 25–90% inert, non-volatile, high-boiling, organic carrier, about 3–35% organic resin having a glass transition temperature of about ambient temperature or below and a particle size of 5 microns or less dispersed in said carrier, and 0 to about 25% dispersing agent. It is critical that the organic resin having a glass transition temperature of about 25°C. or less be inert, that is, that the organic resin dispersed therein must be insoluble in said carrier and also that said organic resin particles remain non-tackified therein.

The non-conductive ink or liquid developer composition may be used for developing latent electrostatic images on a substrate comprising contacting the surface of the substrate containing the latent electrostatic image with the composition. The non-conductive ink of the present invention migrates to the imaged surface without separation of the coloring agent from the carrier solvent.

As used herein coloring agent refers to pigments, dyes, and mixtures thereof.

DESCRIPTION OF THE PREFERRED EMBODIMENTS

In the compositions of the present invention, coloring agent, which is the toner, pigment and/or dye, suspended or dissolved in liquid carrier, and a specified class of organic resins are suspended in the inert, non-volatile, high boiling organic carrier. When the ink or electrostatic printing composition comprises about 3–20% coloring agent, 25–90% inert, non-volatile, high boiling organic carrier, about 3–35% of the specified organic resin and 0 to about 25% dispersing agent, the viscosity of the inks are relatively low and vary from about 200–1000 centipoises at 25°C. The small organic resin particles ranging from submicron particle sizes to 5 microns dispersed in the inert, non-volatile organic carrier must have a glass transition temperature close to or below the ambient temperature. It is this characteristic of the organic resin which results in the liquid developer composition having improved rub resistance.

The liquid organic carriers which may be used in the composition of the present invention, must be inert, non-volatile, and high boiling and must comprise about 25–90% (by weight) of the composition. The organic carrier must be inert to the extent that it does not dissolve the organic resins suspended therein or any of the pigment or toner particles suspended therein. However, certain dyes may be used in conjunction with the pigment dispersed in the carrier, and such dyes may be soluble in the organic carrier. The organic carrier must be a non-volatile liquid in order to prevent evaporation from the composition while standing in an idle machine, or while it is being utilized in a printing or copying process, or while it is deposited upon a substrate. Thus, such non-volatile organic carriers which have been found useful in the present invention, comprise those organic liquids which have boiling points of about 200°C. or higher. Examples of such solvents are alcohols, esters, ethers and the hydrocarbon oils known as mineral oil, and certain aromatic compounds having a boiling point in excess of 200°C. Representative of suitable aromatic solvents which may be used as the carrier in the present invention, are such materials as tetrahydronaphthalene, heptadecylbenzene and 1-chloronaphthalene. Examples of alcohols (including glycols) which may be used in the composition, are tridecanol, diethylene glycol and triethylene glycol. Examples of esters which are useful as carriers or solvents herein are triethylene glycol diacetate and glyceryl triacetate, and examples of glycol ethers which may be used as the solvent are butyl triethylene glycol and hexyl diethylene glycol. Examples of the hydrocarbon oils or mineral oils which may be used in accordance with the present invention, include Magie Oil 520 having a boiling range of 270°C. – 296°C. and Magie Oil 620 having a boiling range of 293°C. – 362°C., both materials supplied under thse tradenames by Magie Bros. Oil Company. While the boiling point is not critical, it is preferred to make use of a solvent component having a boiling point in excess of about 200°C. These solvents when used with the other components of the composition, result in a composition having a relatively high electrical resistivity (in excess of about $10^9$ ohm-cm.), low dielectric constant, and the desired non-tackifying characteristics for the specified organic resins. In accordance with this invention, when the composition has an electrical resistivity in excess of about $10^9$ ohm-cm., it is deemed to be non-conductive.

The dispersed organic resins must have glass transition temperatures close to or below the ambient temperature whether the dispersed resins are used with or without plasticizers. The requirement that the glass transition temperature be close to or below the ambient temperature means that the glass transition temperature of the organic resin must be no higher than aproximately that of the environment in which it is used, and normally temperatures no higher than 35°C. are encountered. Thus, the dispersed organic resins must have a glass transition temperature below about 35°C.

The dispersed, organic resin comprises about 3–35% (by weight) of the composition, and preferably no less than about 5% (by weight) of the resin is used in a composition for liquid developers for developing latent electrostatic images. Generally, one part of resin is used for each part of coloring agent utilized in the composition. About one part of resin for each part of coloring agent is recommended to obtain proper binding of the pigment when the composition is applied to a substrate, however, suitable liquid developers and inks are obtained in accordance with the present invention when more than one part of resin or less than one part of resin is used for every part of coloring agent. Thus, the lower limit of resin used in the composition is, in essence, controlled by the amount of pigment or coloring agent required to provide the proper density when the composition is applied to a substrate such as paper.

In a preferred embodiment of the present invention, a copolymer of maleic acid and butyl methacrylate having a weight-average molecular weight of 31,800 and number-average molecular weight of 3,220 in the form of an organosol, is utilized to prepare the composition of the present invention. Examples of organic resins which are operable in the present invention are found in U.S. Pat. No. 3,232,903 which is incorporated herein by reference. Thus, organic resins having a glass transition temperature of about ambient temperature or below which may be utilized in the composition of the present invention include linear addition polymers or copolymers of ethylenically unsaturated monomers including vinyl esters of fatty acids having 1–18 carbon atoms, esters of acrylic acid with an acohol having 1–18 carbon atoms, esters of methacrylic acid with an alcohol having 1–18 carbon atoms, phenyl acrylate, phenyl methacrylate, acrylonitrile, methacrylonitrile, acrylamide, methacrylamide, styrene, alpha-methyl styrene, vinyl toluene,, acrylic acid, acrylic acid anhydride, methacrylic acid, methacrylic acid anhydride, maleic anhydride, fumaric acid, crotonic acid, allyl acetate, glycidyl methacrylate, t-butylaminoethyl methacrylate, hydroxyalkyl methacrylate, beta-hydroxyethyl vinyl ether, beta-hydroxyethyl vinyl sulfide, vinyl pyrrolidone, N,N-dimethylaminoethyl methacrylate, ethylene, propylene, vinyl chloride, vinyl fluoride, vinylidene fluoride, hexafluoropropylene, chlorotrifluoroethylene, tetrafluoroethylene, lower alkyl vinyl ethers in which the alkyl group has 1 to 4 carbon atoms, p-methoxy-alpha-methylstyrene, vinylidene cyanide, esters of beta-cyano-acrylic acid, trifluoromethylacrylonitrile, N,N-dialkylacrylamides, N,N-dialkylmethacrylamides, and itaconic acid esters. In order to be useful in the compositions of the present invention, the organic resins must have a glass transition temperature of about ambient temperature or below, must be capable of being comminuted to a particle size of no higher than 5 microns and preferably in submicron sizes, and must be of a sufficiently high molecular weight to remain insoluble and non-tackified in the organic carrier.

The coloring agents or toner particles of the developer composition include a wide variety of solid particles as described in U.S. Pat. No. 2,297,691, including talcum powder, aluminum bronze, carbon dust, and the like, the principle requirement being that the particles be electrically attractable. Preferred coloring agents include such powders as nigrosines, or carbonaceous materials, such as carbon black, lamp black, bone black or the like. The coloring agent may be in the form of pigment particles formulated of a suitable dyestuff or carbon black embodied in a resinous carrier. Dyes may also be used as coloring agent in conjunction with pigments. The dyes are generally soluble in the organic carrier and are used to supplement the color in the composition which is attributable to the pigment dispersed therein. One skilled in the art can select a suitable coloring agent which may include a dispersed pigment or combination of pigments or a pigment or combination of pigments in conjunction with one or more dyes. The coloring agents may be dispersed in the organic liquids, dispersed inside the resinous particles, adhered on the surfaces of the resinous particles, or distributed in the carrier in any other suitable manner or a combination thereof. About 3–20% (by weight) coloring agent may be utilized in the composition of the present invention, and as described above, one part of coloring agent is generally used for each part of resin. It is generally preferred that at least 5% (by weight) of the composition be pigment in order to provide sufficient density of the coloring agent when it is deposited upon the substrate. One skilled in the art can determine the amount of coloring agent required for any given composition by determining the density of the developed image upon a substrate.

Other additives and agents may be used in the composition of the present invention as long as such additives do not adversely effect the viscosity, conductivity, print density, and rub resistance of the composition after it has been applied to a substrate.

Up to about 25% of a dispersing agent may be used in the composition of the present invention. The dispersing agent should be soluble in the liquid carrier for best results. Generally a dispersing agent improves the shelf-life of the composition by increasing the ability of the pigment particles and/or the dispersed resin to remain dispersed in the organic carrier upon standing. Illustrative of dispersing agents which may be used in the composition of the present invention without adversely effecting the desired properties thereof, are alkyl phenoxy polyethoxy ethanol, alkylated polyvinyl pyrrolidones, lecithin mixtures, tertiary alkyl primary amines, propoxylated quaternary amines, long chain fatty acid esters containing multiple ether linkages, alkyl alkanolamines, alkyl aryl sulfonates, alkyl sulfosuccinates, and monoglyceride phosphate.

Another additive which may be used in the composition of the present invention without adversely effecting the above-mentioned properties is a plasticizer. Plasticizers are used to adjust the power of the solvent to disperse the resin. However, too high a solvent power will dissolve the resin, and accordingly, too much plasticizer will completely or partially dissolve the organic resin and thereby produce an adverse effect upon the resulting composition. Accordingly, one skilled in the art can adjust the amount of plasticizer which may be used in the composition, however, the plasticizer generally is present in no greater quantity than about 50% of the organic carrier in the composition. The plasticizer is completely miscible with the organic carrier. Examples of plasticizers which may be used in the composition of the present invention are: di-(2-ethyl hexyl) adipate, di-isooctyl adipate, di-isodecyl adipate, di-(2-ethyl hexyl) azelate, triethylene glycol di-2-ethylhexoate, triethylene glycol di-2-ethylbutyrate, triethylene glycol dicaprylate, triethylene glycol dipelargonate, dodecyl alcohol, and di-isooctyl sebacate.

Other additives which may be used in the composition of the present invention include up to about 10% (by weight) of an agent to accelerate the drying of the composition upon the substrate. An example of such a drying acceleration agent is a cyclized rubber having a weight average molecular weight of about 13,000 said cyclized rubber being the reaction product of natural rubber and sulfuric acid. The amount of drying acceleration agent utilized in the composition can be determined by one skilled in the art and may be an amount sufficient to accelerate the drying of the resin in the present composition without adversely effecting the properties including rub resistance of the final deposited composition upon a substrate.

The inks or developer compositions of the present invention are characterized by relatively low viscosities of about 200 to about 1000 centipoises at 25°C. and have excellent pot life. When used as liquid developers and deposited upon a paper substrate, the inks are characterized by excellent rub resistance. This is a substantial improvement over the prior art inks wherein there is an inability of the toner particles to become permanently fixed on the surface of a sheet of, for example, paper, because of tackiness of the toner. Furthermore, inks of the present invention do not depend upon evaporation of the solvent to become fixed upon the substrate, another factor which contributes to the low rub resistance of prior art inks because of the retention of residual solvent in the deposited composition.

In order to measure the "rub-off" or rub resistance of the compositions of the present invention a laboratory device was constructed in accordance with techniques reported in the literature. The device is reported in "Printing Inks and Colors", W. H. Banks, Editor, Pergamon Press, London, 1961, pages 291–302. The reflectance of a rub pattern produced under specified conditions, is measured. The percentage decrease in reflectance of the rubbed spot as compared with the original paper or substrate is taken as a quantitative measure of rub-off or rub resistance. The following technique was used in determining the rub resistance: a hand proof of the ink composition was prepared with a Pamarco Flexo Hand Proofer on the felt side of Xerox 4024 paper. The hand proof was placed on top of two sheets of Xerox 4024 paper which acted as a pad, and rested on an aluminum flat plate of one centimeter thickness. The hand proof was attached to the aluminum plate with tape. A piece of unprinted Xerox 4024 paper with the wire side was down was placed on top of the hand proof. A 500 gram weight with a one inch by one inch glass slide attached to the bottom was then placed on top of the paper. The unprinted paper and the weight were then dragged across the surface of the hand proof at a speed of one centimeter per second and for a distance of ten centimeters by means of an electric motor. A homogeneous rub pattern was obtained in this manner on the paper sheet. The rub pattern obtained in this manner was measured for reflectance by using a Bausch & Lomb Opacimeter backed by a black body. The percentage decrease in reflectance in the background was taken as the rub-off or rub resistance value.

The inks or liquid developers of the present invention have excellent characteristics for application to latent electrostatic images for the development thereof in electrostatographic processes. The relatively high electrical resistivity of the inks, the fine particle sizes of the dispersed particles and the relatively low viscosity of the composition all contribute to the ease with which these compositions are used. Futhermore, the ingredients of the compositions do not separate during migration to the imaged surface. The ink or liquid developer compositions of the present invention do not require any heating or additional drying step to fix the composition to the surface to which it is applied. A latent elctrostatic image on a substrate may be developed by positioning close, but spaced from the electrostatic latent image on the substrate, a composition having about 3–20% coloring, about 25–90% inert, nonvolatile, organic carrier, about 3–35% organic resin having a glass transition temperature of about ambient temperature or below and a particle size of 5 microns or less dispersed in said carrier, and 0 to about 25% dispersing agent; providing flow aiding elements in physical contact between said developer and said substrate; and applying a bias to said developer whereby the developer moves along said flow aiding elements to said substrate thereby developing the electrostatic latent image. The developer may be optionally transferred in configuration to a receiving substrate. The developer or ink becomes fixed to said substrate with little or no evaporation in the absence of heat. The developed image fixed to said substrate has excellent rub resistance.

Although the ink composition of the present invention has excellent properties for developing electrostatic latent images, the ink composition may also be used for various standard printing processes. Furthermore, when the composition is such that higher viscosities are realized, for example, in excess of 1,000 centipoises, the ink composition may be used for such types of printing as offset (lithographic) and the like. In one such application for lithographic purposes, a composition in accordance with the present invention may include about 20–40% coloring agent, about 5–30% dispersed organic resin having a glass transition temperature of about ambient temperature or below and a particle size of 5 microns or less and about 5% to about 30% solvent or liquid carrier. About 0–25% dispersing agent may also be included in the composition as well as other additives such as plasticizers and drying promotion agents. Such compositions for lithographic purposes would have extremely high viscosities and would not be suitable for electrostatic printing purposes, however, such compositions have the proper consistency for use in offset printing.

This invention can be better understood by reference to the following examples, wherein all parts are by weight unless otherwise indicated.

EXAMPLE I

An ink composition having 8.7 % furnace carbon black (Mogul L supplied by Cabot Corporation), 20.3% of a dispersed resin, an acrylic-type resin cmprising a copolymer of maleic acid and butyl methacrylate having a weight-average molecular weight of 31,800 and a number-average molecular weight of 3,220, 42.2% of a hydrocarbon solvent (mineral oil having a boiling point of 334°–357°C.), 1.6% of a dispersing agent, Sotex 3CW supplied by Synthetic Chemicals, Inc., and 27.2% di(2-ethylhexyl) adipate (a plasticizer), was prepared. The dispersing agent dissolved in the solvent system, and the plasticizer was completely miscible therewith.

The ink had a viscosity of 360–380 centipoises at 25°C. and produced prints having excellent rub resistance.

EXAMPLE II

The composition of Example I was prepared with the following variations: 9.8% furnace carbon black, 6.9% of the dispersing agent, 24.5% of the acrylic-type resin of Example I, and 17.7% diisodecyl adipate plasticizer were placed in 41.1% of a mineral oil hydrocarbon solvent having a boiling point of 274°–313°C. The resulting ink composition had a viscosity of 630–660 centipoises at 25°C., and by the method for determining rub-resistance produced prints of excellent rub resistance. The ink composition had excellent properties for use as a liquid developer in an electrostatic copying process and produced excellent prints when used in electrostatic printing.

EXAMPLE III

A composition having 12% furnace carbon black, 1.0% alkylated polyvinyl pyrrolidone dispersing agent, 9.2% of the acrylic-type resin of Example I, 6.8% of a cyclized rubber having a weight average molecular weight of 13,000 and prepared by the reaction of natural rubber and sulfuric acid, 50.6% of a mineral oil hydrocarbon solvent having a boiling point of 274°–313°C. and 20.4% diisodecyl adipate was prepared. The composition had a viscosity of 290–325 centipoises at 25°C. The hand proof of the ink dried in about five minutes with a density of 1.3. The rub resistance was excellent.

EXAMPLE IV

The following composition was prepared by dispersing the pigment and resin in the organic solvent.

| | |
|---|---|
| Furnace carbon black | 11.0% |
| Alkylated polyvinyl pyrrolidone | 1.0% |
| Acrylic-type resin as described in Example I | 7.5% |
| Cyclized rubber as as described Example III | 7.5% |
| di(2-ethyl hexyl) adipate | 20.0% |
| hydrocarbon solvent having a boiling point 271–296°C. | 10.5% |
| hydrocarbon solvent having boiling point 274–313°C. | 42.5% |

The composition prepared above had a viscosity of 250–300 centipoises at 25°C. The hand proof dried in about five minutes, had a density of 1.3 and demonstrated excellent rub resistance.

EXAMPLE V

The following liquid developer composition was prepared.

| | |
|---|---|
| Furnace carbon black | 12.0% |
| Alkylated polyvinyl pyrrolidone dispersing agent | 1.0% |
| Acrylic-type resin described in Example I | 9.2% |
| Cyclized rubber described in Example III | 6.8% |
| Hydrocarbon solvent having a boiling point of 271–296°C. | 50.6% |
| Di(2-ethyl hexyl) adipate | 20.4% |

The liquid developer composition had a viscosity of 265–345 centipoises at 25°C. The hand proof dried in about four minutes and had a density of 1.3. The dried composition had excellent rub resistance.

EXAMPLE VI

A composition having the following ingredients was prepared by dispersing the pigment and the resin in the hydrocarbon solvent carrier and by dissolving the dispersing agent, the cyclized rubber drying acceleration agent and the plasticizer in the hydrocarbon solvent carrier.

| | |
|---|---|
| Furnace carbon black | 12.0% |
| Alkylated polyvinyl pyrrolidone | 1.0% |
| Acrylic-type resin as described in Example I | 8.0% |
| Cyclized rubber of Example III | 8.0% |
| Diisodecyl adipate | 20.0% |
| Hydrocarbon solvent having a boiling point 274–313°C. | 51.0% |

The composition had a viscosity of 385–440 centipoises at 25°C. The hand proof dried in about 11 minutes with a density of 1.4 and demonstrated excellent rub resistance.

EXAMPLE VII

The following liquid developer composition was prepared by dispersing an acrylic-type resin in a hydrocarbon solvent along with the pigment.

| | |
|---|---|
| Furnace carbon black | 12.0% |
| Alkylated polyvinyl pyrrolidone | 1.0% |
| Acrylic-type resin as described in Example I | 17.4% |
| Hydrocarbon solvent having boiling point of 274–313°C. | 34.8% |
| Diisodecyl adipate | 34.8% |

The ink had a viscosity of 860–1000 centipoises at 25°C. The hand proof dried in about 25 minutes with a density of 1.4 and demonstrated good rub resistance.

EXAMPLE VIII

A liquid developer composition having the following ingredients was prepared:

| | |
|---|---|
| Furnace carbon black | 11.0% |
| Blue pigment (Alkali Blue R supplied by Chemetron Corp.) | 1.0% |
| Alkylated polyvinyl pyrrolidone dispersing agent | 1.0% |
| Acrylic-type resin described in Example I | 9.2% |
| Cyclized rubber drying agent disclosed in Example III | 6.8% |
| Hydrocarbon solvent having boiling point 274–313°C. | 50.6% |
| Diisodecyl adipate | 20.4% |

The ink composition had a viscosity of 430–490 centipoises at 25°C. The hand proof dried in about five minutes and had a density of 1.3 with excellent rub resistance.

The ink compositions prepared in the above examples had characteristics suitable for use as liquid developers in the development of latent electrostatic images. The rub resistance test applied in each case demonstrated that the ink composition had good to excellent rub resistance, and accordingly, the inks are suitable for application to latent electrostatic images which have been formed on the photoconductive surface of a recording element by uniformly charging the surface thereof, as by a corona discharge device, followed by exposure to light in the desired image pattern. The images are then developed by the application of the non-conductive liquid developer to the imaged surface for development in image configuration. The rub resistance of the compositions of this invention have been demonstrated.

It should be understood that the foregoing description is for the purpose of illustration only and that the invention includes all modifications falling within the scope of the appended claims.

We claim:

1. An ink composition comprising about 3–20 percent coloring agent, about 25–90 percent inert, nonvolatile, organic carrier, about 3–25 percent organic resin having a glass transition temperature of about ambient temperature or below and a particle size of 5 microns or less dispersed in and insoluble in said carrier, and 0 to about 25 percent dispersing agent.

2. The composition of claim 1 wherein the organic carrier comprises up to about 50% plasticizer.

3. The composition of claim 1 wherein the resin is in the form of an organosol.

4. The composition of claim 1 wherein the resin is a copolymer of maleic acid and butyl methacrylate having a weight-average molecular weight of about 31,000.

5. The composition of claim 1 wherein the ratio of resin to coloring agent is about 1:1.

6. The composition of claim 1 wherein the coloring agent comprises at least 5 weight percent of the composition and the resin comprises at least 5 weight percent of the composition.

7. The composition of claim 1 wherein the resin has a glass transition temperature of about 35°C. or less.

8. The composition of claim 1 further comprising up to about 10 weight percent of an agent to accelerate drying time.

9. The composition of claim 8 wherein the drying acceleration agent is a cyclized rubber having a weight average molecular weight of about 13,000, said cyclized rubber being the reaction product of natural rubber and sulfuric acid.

10. The composition of claim 1 wherein the viscosity is about 200 to about 1,000 centipoises at 25°C.

11. An ink composition comprising about 20–40 percent coloring agent, about 5–30 percent inert, nonvolatile, organic carrier, about 5–30 percent organic resin having a glass transition temperature of about ambient temperature or below and a particle size of 5 microns or less dispersed in and insoluble in said carrier, 0 to about 25 percent dispersing agent, up to about 50 percent plasticizer, and up to about 10 percent of an agent to accelerate drying time.

12. The composition of claim 11 wherein the viscosity is greater than about 1,000 centipoises at 25°C.

13. The composition of claim 11 wherein the resin is in the form of an organosol.

14. The composition of claim 11 wherein the resin is a copolymer of maleic acid and butyl methacrylate having a weight-average molecular weight of about 31,000.

15. The composition of claim 11 wherein the resin has a glass transition temperature of about 35°C. or less.

16. The composition of claim 11 wherein the agent to accelerate drying time is a cyclized rubber having a weight average molecular weight of about 13,000, said cyclized rubber being the reaction product of natural rubber and sulfuric acid.

* * * * *